US005255987A

United States Patent [19]

Mizuno et al.

[11] Patent Number: 5,255,987

[45] Date of Patent: Oct. 26, 1993

[54] PAPER MARGIN DETECTING DEVICE FOR USE IN PRINTING APPARATUS

[75] Inventors: Toshiaki Mizuno; Mamoru Imaizumi, both of Nagoya, Japan

[73] Assignee: Brother Kogyo Kabushiki Kaisha, Nagoya, Japan

[21] Appl. No.: 904,607

[22] Filed: Jun. 26, 1992

[30] Foreign Application Priority Data

Jul. 25, 1991 [JP] Japan ..... 3-210270

[51] Int. Cl.[5] ..... B41J 5/30

[52] U.S. Cl. ..... 400/61; 400/64; 400/705; 400/279

[58] Field of Search ..... 400/61, 64, 703, 707, 400/279, 282, 283, 284

[56] References Cited

U.S. PATENT DOCUMENTS

| | | | |
|---|---|---|---|
| 4,462,701 | 7/1984 | Czyszczewski et al. | 400/64 |
| 4,618,275 | 10/1986 | Brinkman | 400/76 |
| 4,653,940 | 3/1987 | Katsukawa | 400/54 |
| 4,861,175 | 9/1989 | Hori et al. | 400/76 |
| 4,898,488 | 2/1990 | Yokoi et al. | 400/642 |
| 4,920,882 | 5/1990 | Hoyt | 400/64 |
| 4,960,336 | 10/1990 | Brooks et al. | 400/61 |
| 5,033,879 | 7/1991 | Abe et al. | 400/61 |

*Primary Examiner*—Eugene H. Eickholt
*Attorney, Agent, or Firm*—Oliff & Berridge

[57] ABSTRACT

A paper edge detecting device for a printing apparatus in which a paper margin of a print paper can be detected with high accuracy. A mark printing process is executed upon power-on of a printer, so that a carriage is displaced from an original position H0 to a position corresponding to a set pulse number $H_P$ and stopped at that position to print on the print paper a linear mark M aligned in a direction perpendicular to a displacement direction of the carriage. Thereafter, a mark detection process is executed, and the carriage is displaced from the original position H0 until the mark M is detected by the photosensor. Subsequently, a correction amount generating process is executed to calculate a correction value $\alpha$ on the basis of the set pulse number $H_P$ and the count value $C_P$ when the mark M is detected by the photosensor.

8 Claims, 12 Drawing Sheets

FIG. 6B

| START MARK PRINTING PROCESS | |
|---|---|
| S30... | DRIVE CARRIAGE DRIVING MOTOR IN REVERSE DIRECTION |
| S31... | GP = "H" LEVEL ? |
| S32... | CEASE CARRIAGE DRIVING MOTOR |
| S33... | CLEAR CARRIAGE POSITION MEMORY AND CORRECTION-AMOUNT MEMORY |
| S34... | SUPPLY PRINT PAPER |
| S35... | READ IN SET PULSE Hp |
| S36... | DRIVE CARRIAGE DRIVING MOTOR IN FORWARD ROTATIONAL DIRECTION |
| S37... | $C_P$ = Hp ? |
| S38... | CEASE CARRIAGE DRIVING MOTOR |
| S39... | PRINT MARK |

FIG. 7B

| START MARK DETECTING PROCESS | |
|---|---|
| S50... | DRIVE CARRIAGE DRIVING MOTOR IN REVERSE |
| S51... | GP = "H" LEVEL ? |
| S52... | DRIVE LINE FEED MOTOR IN REVERSE DIRECTION |
| S53... | CLEAR CARRIAGE POSITION MEMORY AND RESET PAPER DIRECTION FLAG PF |
| S54... | DRIVE CARRIAGE DRIVING MOTOR IN FORWARD DIRECTION |
| S55... | PF FLAG SET, PF = 1? |
| S56... | $D_o > D_s$? |
| S57... | SET PF FLAG, PF←1 |
| S58... | $D_o < D_s$? |
| S59... | CEASE CARRIAGE DRIVING MOTOR |

PAPER MARGIN DETECTING DEVICE FOR USE IN PRINTING APPARATUS

BACKGROUND OF THE INVENTION

1. Field of the Invention

This invention relates to a paper margin detecting device for use in a printing apparatus, and particularly to a paper margin detecting device for accurately detecting the position of a left margin of a print paper which is fed onto a platen using a sensor mounted to a carriage.

2. Description of Related Art

As one of conventional printing apparatuses, such as a wire dot printer, a thermal printer and a laser printer, there has been proposed a printing apparatus in which a compact type of paper detecting photosensor is provided to a carriage for moving a print head, and on the basis of a sensor signal from the photosensor it is detected whether a print paper has been fed onto a platen, that is, whether the print paper exists on the platen. In the printing apparatus as described above, even though the print paper is fed to a substantially predetermined position on the platen by aligning the left margin of the paper, there is enough variation in feed that the print paper which has been fed onto the platen is not precisely located at a fixed position, and thus the locating position of the print paper on the platen varies slightly for every print paper so fed.

Particularly in a case where a print paper fed onto the platen is required to have a very small margin amount (a small area of blank portion: for example, about 1 mm width) at the peripheral portion thereof in order to print characters or an image on substantially the entire surface of the print paper, it is essential that the left margin of the print paper be accurately detected. In order to satisfy this requirement, a paper margin detecting device containing a photosensor fixed to a carriage is provided so that the left margin of the print paper can be accurately detected by the paper margin detecting device.

In this device, the photosensor may be disposed at the same position as the print head in a printing direction, or may be disposed so as to be displaced from the print head by a predetermined distance in the printing direction or the opposite direction thereto. However, this device has a problem in that an installation or fixing error frequently occurs when the photosensor is installed or fixed to the carriage. That is, the photosensor is structured to emit a light beam from a light emitting element to be irradiated onto an object and the light beam reflected from the object is detected by a photosensitive element. However, with this structure various errors, such as an inclination error and a fixing-position error, of the sensor with respect to the platen, result directly in a detection error. In order to prevent occurrence of these errors, the sensor must be fixed to the carriage with high accuracy. Further, any adjustment of the fixing position of the sensor is very complicated, requiring a lot of time and labor. In addition, even if these errors are maximally suppressed, it is impossible to completely extinguish them and, thus, the accuracy of the paper margin detection is limited.

SUMMARY OF THE PRESENT INVENTION

An object of this invention is to provide a paper margin detecting device for use in a printing apparatus in which the position of a margin of a print paper can be detected with high accuracy.

In order to attain the above object, a paper margin detecting device for use in a printing apparatus comprising a platen, a carriage having a print head which is reciprocatively movable along the platen, a carriage driving means for reciprocatively driving the carriage and an original position setting means for setting an original position for the reciprocative movement of the carriage, includes a carriage position detecting means for detecting a displacement position of the carriage from an original position thereof, a carriage position memory for receiving a position signal from the carriage position detecting means and storing the displacement position of the carriage from the original position while renewing the displacement position, a mark printing instruction means for instructing the print head to print a prescribed mark at a position which is spaced from the original position by a prescribed distance on a printing medium, a detecting means provided to the carriage for detecting the mark and the margin of a paper serving as the printing medium, and a correction amount generating means for generating a correction amount for the displacement position of the carriage at a paper margin detecting time on the basis of the carriage positions when the mark is printed by the mark printing instruction means and when the mark is detected by the detecting means.

In the paper margin detecting device for use in the printing apparatus according to this invention, the original position setting means serves to set the original position of the carriage, and the carriage position detecting means serves to detect a displacement position of the carriage from the original position when the carriage is driven by the carriage driving means. The carriage position memory receives a carriage-position signal from the carriage position detecting means, and stores the displacement position of the carriage from the original position while renewing the displacement position.

On the other hand, the mark printing instruction means instructs the print head to print a prescribed mark, for example, a linear mark expanding in a direction perpendicular to the displacement direction of the carriage, at a position which is spaced from the original position at any distance on the printing medium, and the detecting means detects the mark printed on the printing medium. The correction amount generating means generates a correction amount used to correct a carriage displacement position at the paper-margin detecting time by the detecting means on the basis of carriage positions when the mark is printed by the mark printing instruction means and when the mark is detected by the detecting means. That is, the mark is printed at a position to which the carriage is displaced from the original position by any predetermined distance, and the correction amount is calculated on the basis of both of the carriage positions when the mark is printed and when the mark is detected by the detecting means. The correction amount includes a shift amount between the print head and the detecting means and a installation error of the detecting means, and the displacement position of the carriage at the paper detecting time is corrected with this correction amount, so that the distance between the original position of the carriage and the paper margin can be accurately calculated, and the print head can therefore be accurately located at the paper margin. In addition, there are problems due to the installation error of the detecting means, so that with this invention it is not necessary to carry out any adjustment of the fixing position of the detecting means after the detecting means is secured to the carriage.

BRIEF DESCRIPTION OF THE DRAWINGS

FIG. 6B is a table of labels for FIG. 6A;

FIG. 7B is a table of labels for FIG. 7A;

DESCRIPTION OF THE PREFERRED EMBODIMENT

A preferred embodiment of the invention will be described with reference to the accompanying drawings.

The following description is made representatively for an embodiment in which the invention is applied to a wire dot printer.

Figure 1:
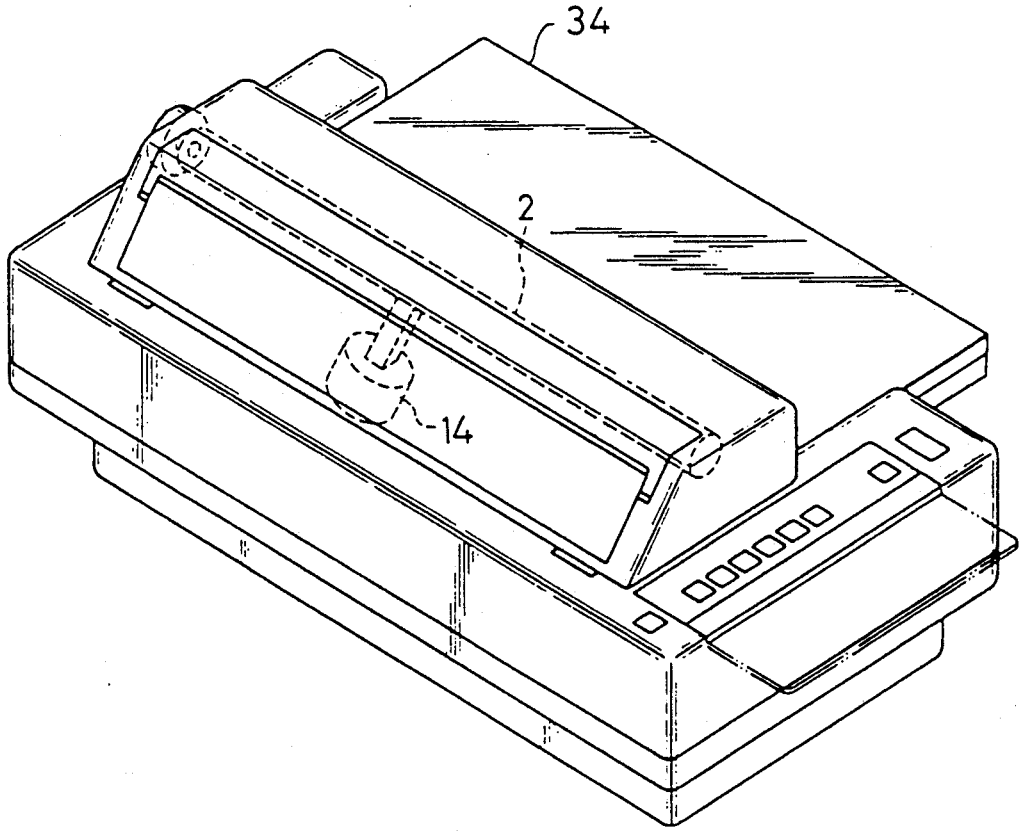
FIG. 1 is a perspective view of a wire dot printer.
Figure 2:
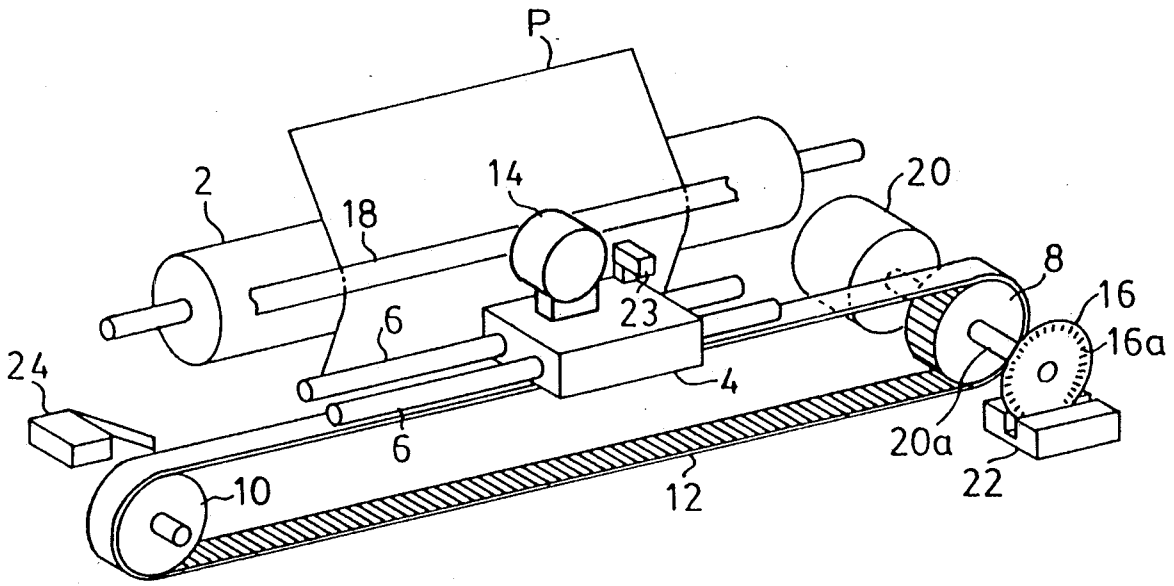
FIG. 2 is a schematic perspective view of a printing mechanism of a wire dot printer.

FIG. 1 is a perspective view of the basic construction of a wire dot printer (WP). The wire dot printer (WP) shown in FIG. 1 has substantially the same construction as a general dot printer which is disclosed, for example, in U.S. Pat. Nos. 4,653,940 or 4,898,488. Prior to the detailed description of this embodiment, a printing mechanism of the wire dot printer will be first described briefly with reference to FIG. 2.

A platen 2 is disposed so as to extend in a left-and-right direction and is rotatably supported at the axis thereof by a frame (not shown). The platen 2 is rotatably driven in a paper supply direction or in a counter direction thereto by a line feed motor 21 (see FIG. 3). A carriage 4 is disposed at a front side of the platen 2 and is supported by a pair of guide shafts 6 so as to be reciprocatively movable along the platen 2 in the left-and-right direction. The carriage 4 is fixed to a portion of a timing belt 12 which is suspended between a driving pulley 8 fixed to a driving shaft 20*a* of a carriage driving motor 20 and a driven pulley 10, and is reciprocatively moved in the left-and-right direction by the carriage driving motor 20. In this embodiment, the carriage driving motor 20 comprises a D.C. motor, and the printing mechanism is so designed that the carriage 4 is displaced in the right direction in FIG. 2 when the carriage driving motor 20 is driven in a forward rotational direction, while the carriage 4 is displaced in the left direction in FIG. 2 when the carriage driving motor is driven in a reverse rotational direction. The carriage 4 is equipped with a print head 14 having twenty four pins and twenty four pin solenoids for individually driving each of the pins independently of the other pins, and a photosensor 23 for detecting the left margin of a print paper P fed onto a platen 2 and a mark M as described later. The photosensor 23 comprises a light emitting element of a light emitting diode and a photosensitive element of a phototransistor.

An encoder disk 16 is fixed to the driving shaft 20*a*, and plural slits (for example, 200 slits) 16*a* are circularly formed at a predetermined interval at the peripheral portion of the encoder disk 16. A photointerruptor 22 for detecting each of the plural slits 16*a* is secured to the frame. The photointerruptor 22 outputs an encoder signal (pulse signal) to an input/output interface 28 of a control device C in response to detection of any one of the slits 16*a* which are moved by the rotation of the encoder disk 16. An original position setting switch 24 is secured to the frame at a position adjacent to a left marginal (limited) position for the carriage displacement in the left direction. A printing ribbon 18 is disposed just behind the print head 14, and is wound up in a predetermined direction interlockingly with the movement of the carriage 4 by a printing ribbon winding mechanism. The ribbon winding mechanism is driven by a ribbon feed motor 33 which is rotated by a driving circuit 32.

As shown in FIG. 1, the dot printer WP is equipped with a paper cassette 34, in which plural print papers P can be stored, and is so designed that the print paper P in the paper cassette is automatically fed onto the platen 2 in response to a printing instruction or a page feed instruction.

Figure 3:
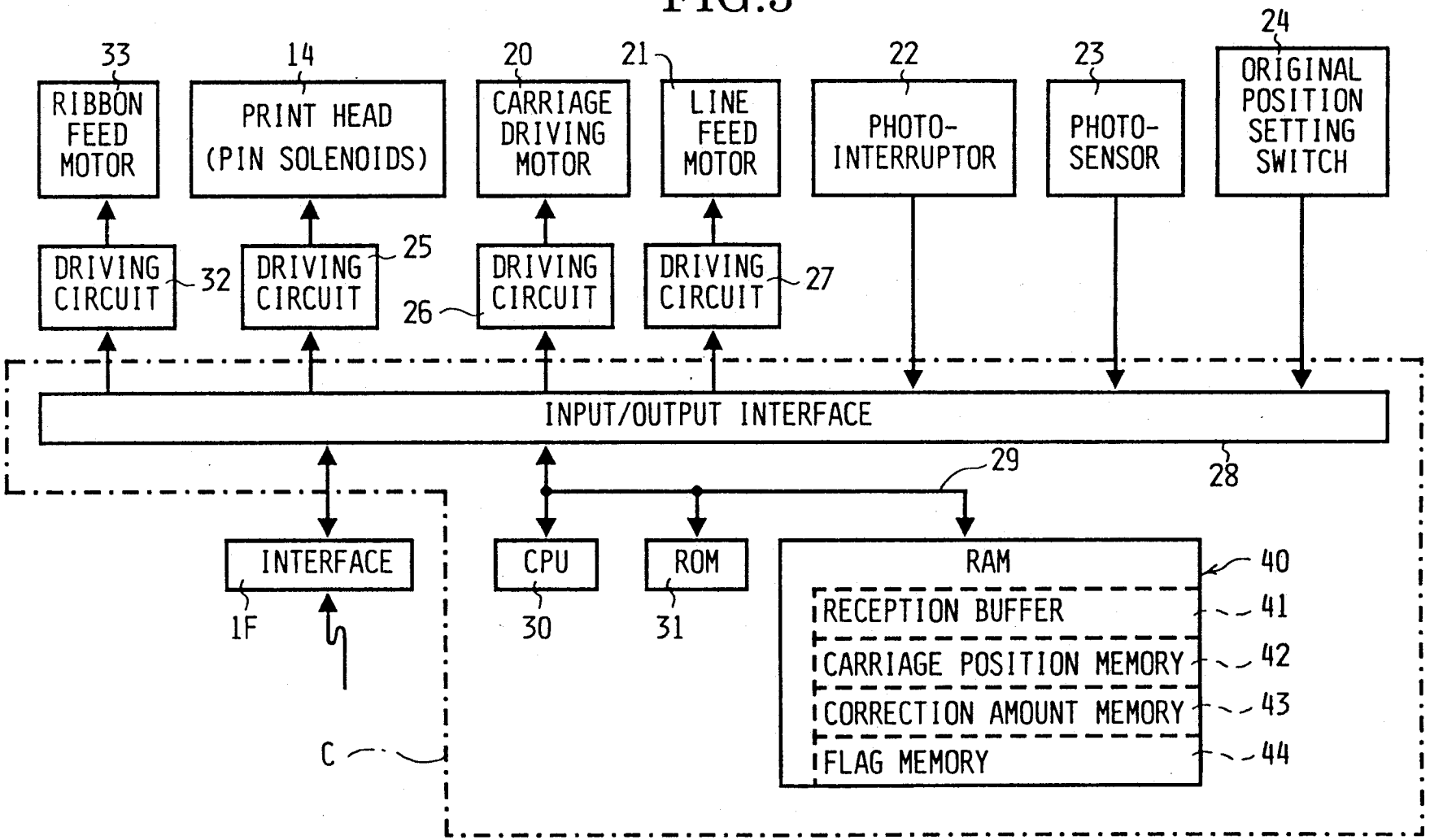
FIG. 3 is a block diagram of a control system of the wire dot printer.

The control system of the dot printer WP is constructed as shown in a block diagram of FIG. 3.

A driving circuit 25 for the pin solenoids of the print head 14, a driving circuit 26 for the carriage driving motor 20, a driving circuit 27 for the line feed motor 21, the photointerruptor 22, the photosensor 23, the original position setting switch 24, a driving circuit 32 for the ribbon feed motor 33, and a serial interface IF for receiving a printing data transmitted from an external equipment, such as a word processor or a personal computer, are connected to the input/output interface 28 of the control device C. The original position setting switch 24 outputs an original position signal GP whose state is switched to an "H" level state when the carriage 4 is displaced to the original position, and to an "L" level state when the carriage 4 is displaced to positions other than the original position. The sensor signal $D_0$ of the photosensor 23 becomes a sensor signal $D_L$ having a relatively small level when it represents the platen 2 and the mark M, and becomes a sensor signal $D_H$ having a relatively large level when it represents the print paper P.

The control device C comprises a CPU 30, the input/output interface 28, a ROM 31 and a RAM 40 which are connected through a bus 29 such as a data bus to the CPU 30.

Figure 4:
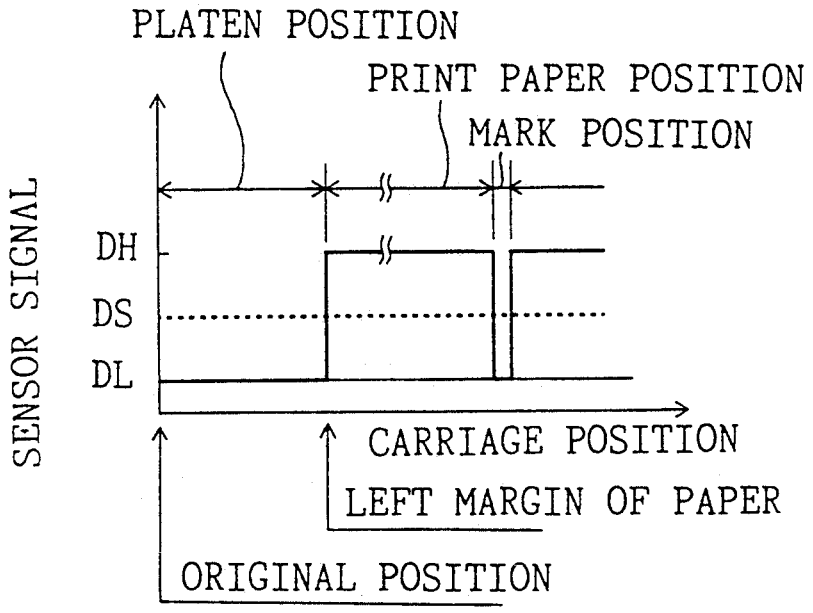
FIG. 4 is a diagram showing the signal level of a sensor signal which is output from a photosensor.
Figure 5:
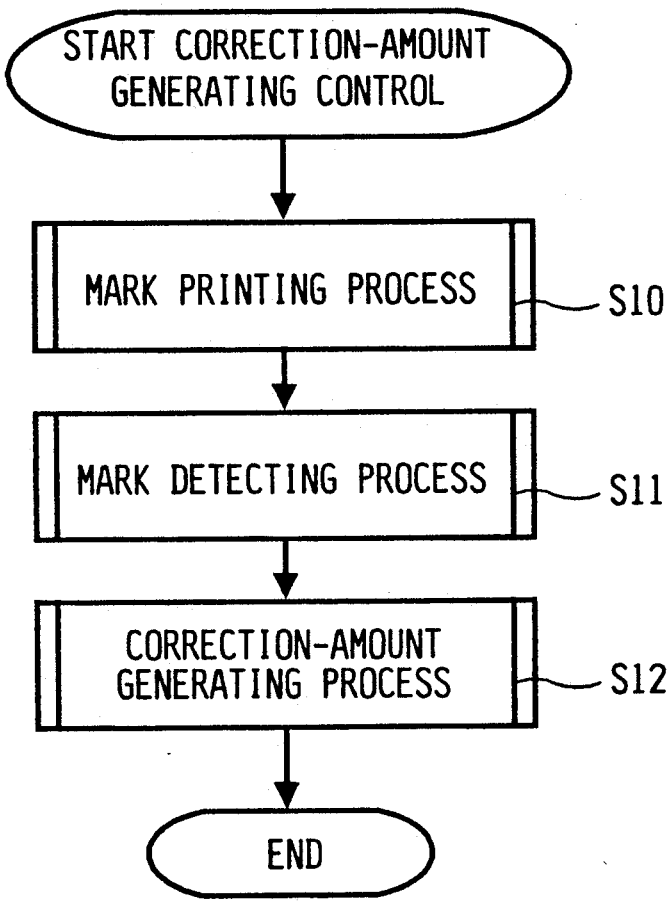
FIG. 5 is a flowchart showing a routine for a correction amount generating control for paper margin detection.
Figure 6A:
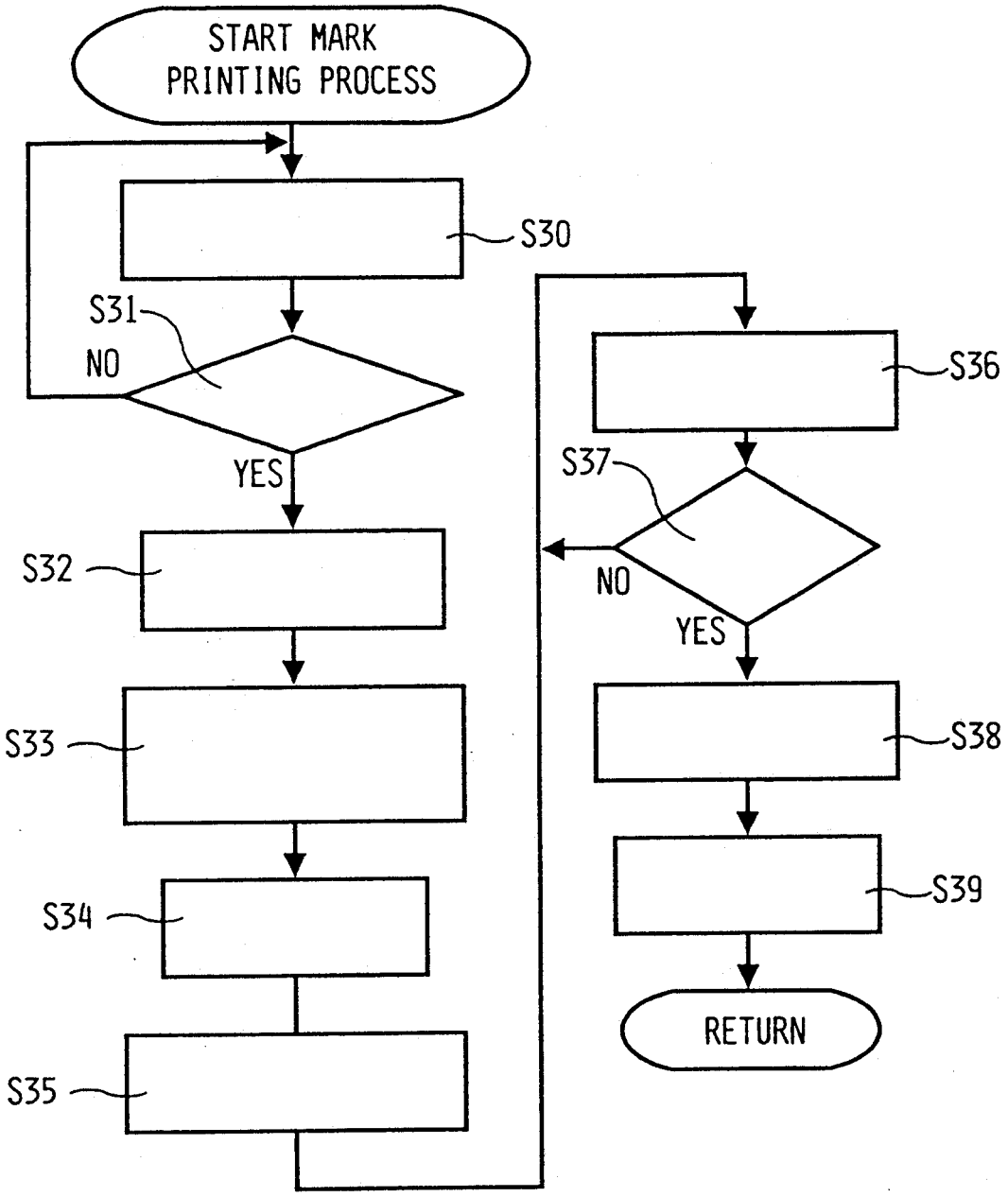
FIG. 6A is a flowchart showing a routine for a mark printing process.
Figure 7A:
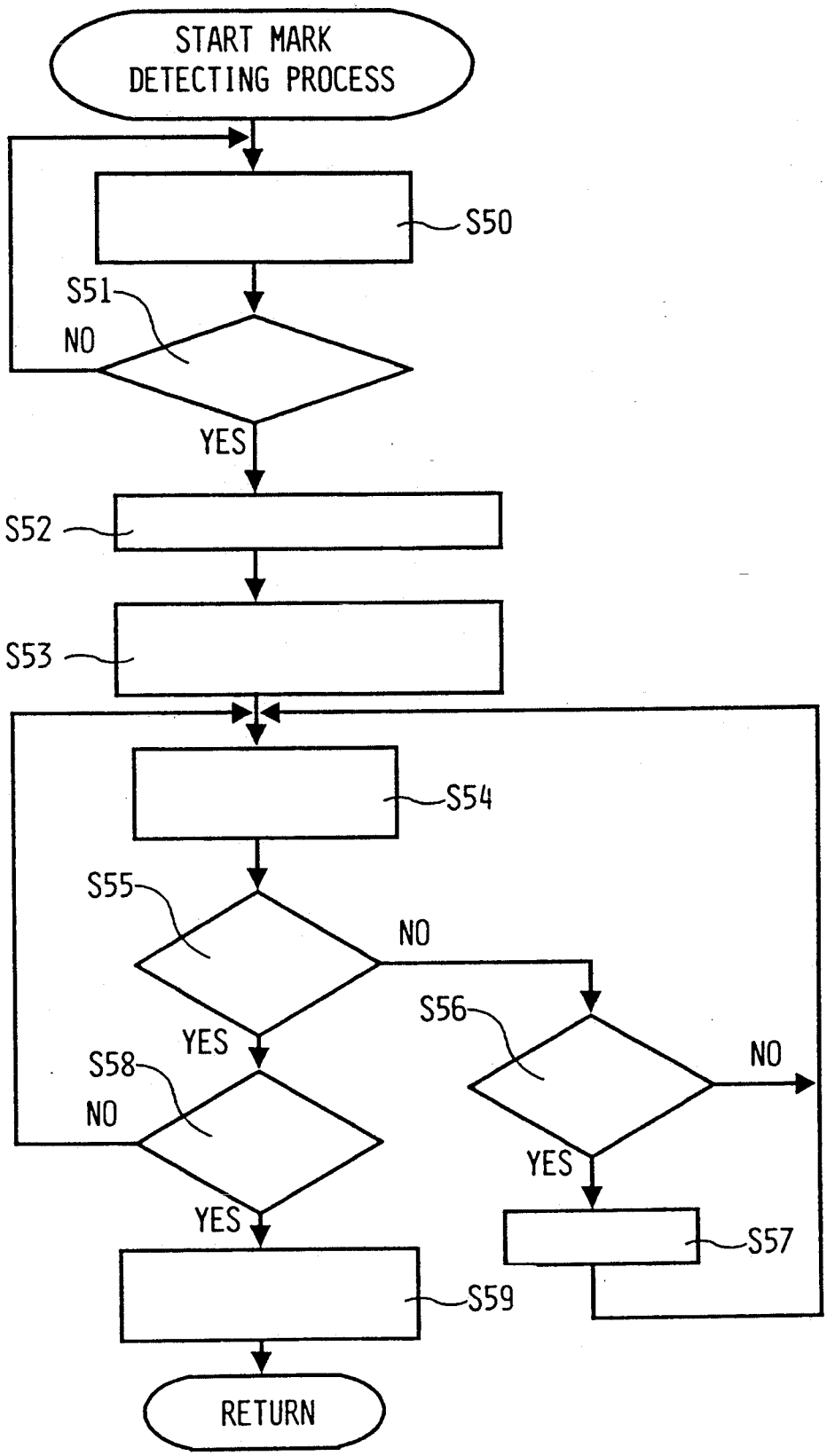
FIG. 7A is a flowchart showing a routine for a mark detecting process.

The ROM 31 is provided with a program memory storing various control programs for controlling the driving of the respective motors 20 and 21 of the printing mechanism and the print head 14, an automatic paper supply control program for driving the automatic paper supply mechanism and a control program for correction amount generating control for a paper-margin detecting operation, as described later and a pattern memory in which plural character dot data such as the mark M, characters and symbols have been stored. Also stored in the ROM 31 are data for a set sensor signal $D_S$ (see FIG. 4) corresponding to a substantially intermediate value between the sensor signals $D_H$ and $D_L$, and data for a set pulse number $H_P$ corresponding to a prescribed distance between the original position of the carriage 4 and a substantially central position of the platen to which the carriage 4 would be displaced from the original position to print the mark M on the print paper P.

The RAM 40 is provided with a reception buffer 41 for storing the printing data transmitted from the external equipment, a carriage position memory 42 for counting an encoder signal supplied from the photointerruptor 22 with the original position of the carriage 4 being a reference point to thereby detect a displacement position of the carriage 4 from the original position (a count value is represented by $C_P$), a correction amount memory 43 for storing a calculated correction amount, a flag memory 44 for storing a flag data of a paper detection flag PF, which will be set (to "1") when the left margin of the print paper is detected, and various memories for temporarily storing a calculated result obtained in the CPU 30.

Next, the correction-amount generating control routine for the paper margin detection which is carried out in the control device C of the wire dot printer WP will be described with reference to the flowcharts of FIGS. 5 through 8. Through an encoder signal storing control, the count operation of a pulse number of the encoder signal is carried out every input of the encoder signal from the photointerruptor 22 while the pulse number is counted up or down in accordance with the displacement direction of the carriage 4, and a count value CP is successively renewed and stored in a carriage position memory 42. A reference numeral Si (i=10, 11, 12 . . . ) in the figures represents each step of the routine.

The correction-amount generating control for the paper-margin detecting operation is carried out every time the printer WP is powered on. A mark printing process (see FIG. 6) will be executed first (step S10). Upon the start of the mark printing process, the carriage 4 is first displaced to the original position at steps S30 and S31. The carriage driving motor 20 is driven in the reverse rotational direction for a very short time (step S30). If the original position signal GP from the original position setting switch 24 has no "H" level (judgement of "No" at the step S31), the steps of S30 and S31 are repeated. Thereafter, when the carriage 4 is displaced to the original position and the original position signal GP has "H" level (judgement of "Yes" at the step S31), the driving of the carriage driving motor 20 is ceased (step S32). Through the control at the steps S30 and S31, the carriage 4, and thus the print head 14, is displaced to a carriage position H0 which corresponds to the original position.

Figure 9:
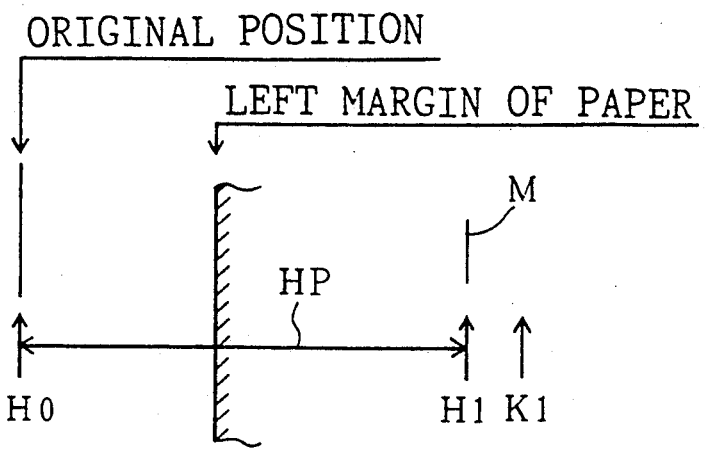
FIG. 9 is a diagram showing the positional relationship between the mark, the print head and the photosensor in the mark printing process.

Subsequently, each of the carriage position memory 42 and the correction amount memory 43 is cleared (Step S33), and the print paper P is automatically fed onto the platen 2 by the driving of the automatic paper supply mechanism (step S34). Thereafter, a set pulse number $H_P$ is read in (step S35) and the carriage driving motor 20 is driven in the forward rotational direction until the count value $C_P$ of the carriage position memory 42 is equal to the set pulse number $H_P$ (judgement of "No" at steps S36 and S37). When the count value $C_P$ is equal to the set pulse number $H_P$ (judgement of "Yes" at a step S37), the driving of the carriage driving motor 20 is ceased (step S38). At that time, the mark M is printed on the print paper P by the print head 14 (step S39) and the process is completed to return to Step S11. For example, as shown in FIG. 9, the carriage 4 is displaced from the carriage position H0 to a carriage position H1 which is spaced from the carriage position H0 at a distance corresponding to the set pulse number $H_P$ in the printing direction and stopped at that position H1 to print on the print paper P a linear mark M expanding in a direction perpendicular to the displacement direction of the carriage 4. The sensor position of the photosensor 23 at this time is represented by K1.

Next, the mark detection process (FIG. 7) is executed (step S11). Upon start of the mark detection process, steps S50 and S51 are first repeated to displace the carriage 4 to the original position thereof similar to the process at the steps S30 and S31. Thereafter, the line feed motor 21 is driven in the reverse rotational direction for a prescribed period to feed the print paper P in the opposite direction to the paper supply direction (step S52) so that the mark M on the print paper P is aligned with the photosensor 23, the carriage position memory 42 is cleared and the paper detection flag PF is reset (step S53).

Figure 10:
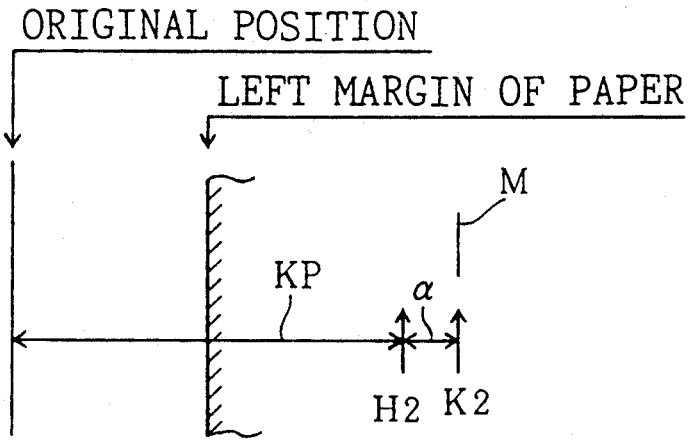
FIG. 10 is a diagram showing the positional relationship between the mark, the print head and the photosensor in the mark detecting process.

Subsequently, the carriage driving motor 20 is driven in the forward rotational direction for a very short time (step S54). At this time, if the sensor signal $D_0$ of the photosensor 23 is the sensor signal $D_L$, representing the platen, and thus the level thereof is lower than that of the set sensor signal $D_S$ (judgement of "No" at a step S56) in a state where the flag PF is reset (judgement of "No" at a step S55), the steps S54 and S56 are repeated to successively displace the carriage 4 from the original position thereof in the printing direction. When the photosensor 23 is displaced to the left margin of the print paper P so that the sensor signal $D_0$ is changed to $D_H$, that is, the level of the sensor signal $D_0$ is higher than that of the set sensor signal $D_S$ (judgement of "Yes" at the step S56), the flag PF is set (step S57), and the carriage 4 is displaced in the printing direction until the photosensor 23 confronts the mark M (the step S54, judgement of "Yes" at the step S55 and judgement of "No" at the step S58) until mark M is confronted. The photosensor 23 is displaced to the position where it confronts the mark M, and if the sensor signal $D_0$ is changed to $D_L$, that is, the level of the sensor signal $D_0$ is lower than that of the set sensor signal $D_S$ (judgement of "Yes" at the step S58), the driving of the carriage driving motor 20 is ceased, the carriage 4 is stopped at this position (step S59) and the process is completed and returned to step S12. For example, as shown in FIG. 10, when the photosensor 23 is located at a sensor position K2 where it confronts the mark M, the displacement of the carriage 4 is ceased. The carriage position at this time is represented by H2 and the count value in the carriage position memory 42 at this time is represented by $K_P$.

Figure 8:
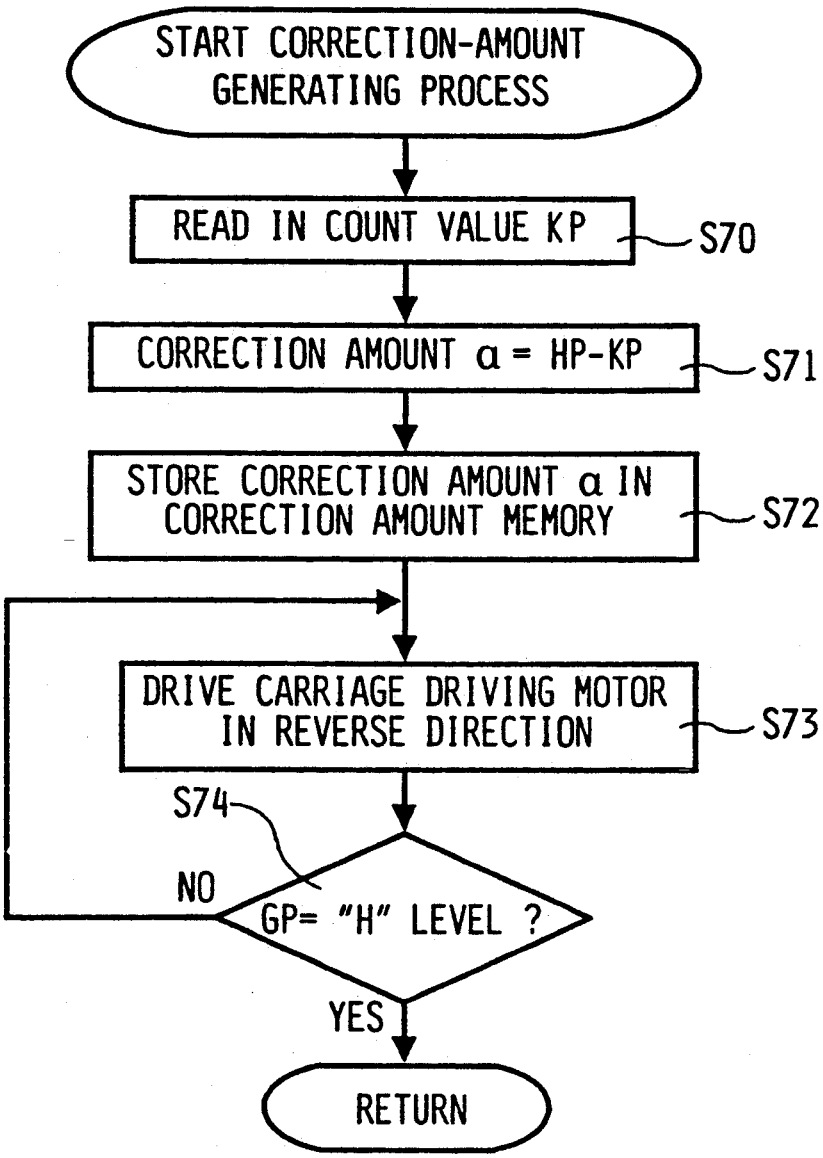
FIG. 8 is a flowchart showing a routine for a correction amount generating process.

Subsequently, the correction amount generating process (FIG. 8) is executed (step S12). Upon the start of the correction amount generating process, a current count value $K_P$ of the carriage position memory 42 is first read in (step S70) to calculate a correction amount $\alpha$ using a calculating equation ($\alpha$=(set pulse number $H_P$)−(count value $K_P$)) (step S71). The calculated correction amount $\alpha$ is stored in the correction amount memory 43 (step S72), the carriage 4 is displaced to the original position thereof (steps S73 and S74), and the process is completed. For example, as shown in FIGS. 8–10, the correction amount $\alpha$ is equal to a difference value obtained by subtracting the current count value $K_P$ from the set pulse number $H_P$.

Figure 11:
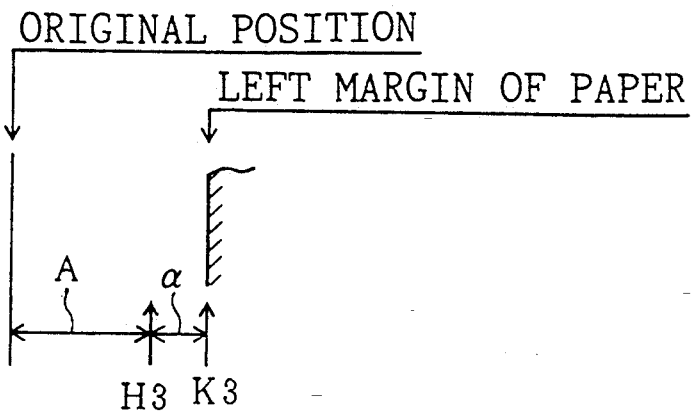
FIG. 11 is a diagram showing the positional relationship between the print head and the photosensor when the paper margin is detected by the photosensor in the printing operation and the correction amount.
Figure 12:
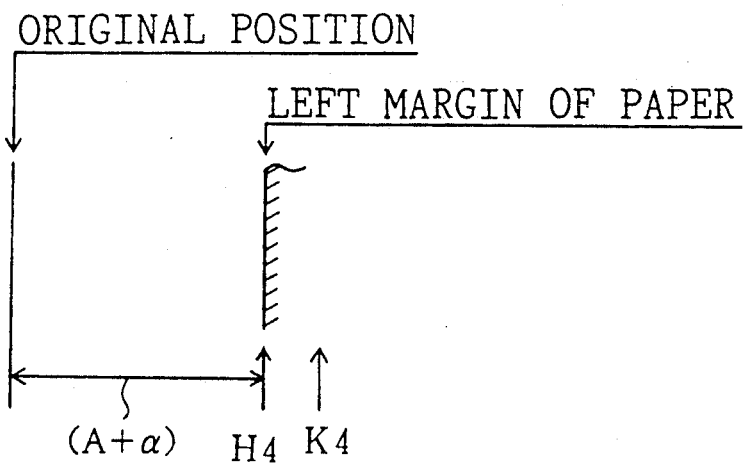
FIG. 12 is a diagram showing the positional relationship between the paper margin and the print head when the position of the print head is corrected with the correction amount.

That is, the mark M is printed at a position to which the carriage 4 is displaced from the original position in accordance with the set pulse number $H_P$ which is set beforehand and the correction amount $\alpha$ is calculated on the basis of the set pulse number $H_P$ and the count value $K_P$ obtained when the mark M is detected by the photosensor 23. The calculated correction amount $\alpha$ includes not only a shift distance between the print head 14 and the photosensor 23 but also any installation error of the photosensor 23. Therefore, since the carriage 4 is located at the carriage position H3 which provides a count value A and is spaced at a distance corresponding to the correction amount $\alpha$ from the sensor position K where the left margin of the print paper P is detected, as shown in FIG. 11, a distance between the original position of the carriage 4 and the left margin of the print paper can be accurately obtained by displacing the carriage 4 to the carriage position H4 which provides a count value ($A+\alpha$), as shown in FIG. 12, so that the print head 14 can be accurately displaced to such a position that it confronts the left margin of the print paper. In addition, any problem due to the installation error of the photosensor is eliminated, and the need to adjust the installing position of the photosensor 23 on the carriage 4 can be eliminated.

Further, since the correction-amount generating control for the sheet edge detection is executed every time the apparatus is powered on, even if an optical characteristic of the photosensor 23 varies due to a long-term use, the variation amount of the optical characteristic is automatically contained in the correction amount $\alpha$ as described above, and thus the distance between the original position of the carriage 4 and the left margin of the print paper can be accurately calculated at all times.

The variation of the optical characteristic of the photosensor 23 is induced as follows. The sensor signal $D_0$ is varied in a range of $D_L$ to $D_H$ due to reduction of light emission amount or dirt buildup on the photosensitive element so that the rise-up of the sensor signal $D_0$ is moderate when it traverses the level of the set sensor signal $D_S$. Therefore, in comparison with the initial stage, a time required for detecting the level variation of the sensor signal $D_0$ is increased with a lapse of time and this increase in the detection time causes an error.

Still further, in this embodiment the correction value is calculated through detection of the left margin of the paper, however, this invention is not limited to this embodiment. For example, the correction amount may be calculated through detection of the right margin of the paper.

This invention is also applicable to a paper edge detecting device for use in various printing apparatuses such as an electric typewriter having a paper-edge detecting capability which is equipped with a printer such as a wire dot type printer, a thermal printer or a typewheel printer. Further, the carriage driving motor 20 may be a stepping motor, and a pulse number for driving the motor may be stored in the carriage memory 42 to perform the same correction amount generating control for the paper margin detection as carried out in the embodiment as described above.

What is claimed is:

1. A printing apparatus for printing an image on a printing medium having a printing medium margin detecting function, comprising:

a platen for supporting a printing medium;

a carriage having a print head which is reciprocatively movable along the platen;

a carriage driving means for reciprocatively driving the carriage;

an original position setting means for setting an original position for the reciprocative movement of the carriage;

a carriage position detecting means for detecting a displacement position of the carriage from an original position thereof;

a mark printing instruction means for instructing the print head to print a mark at a position which is spaced from the original position by a predetermined distance on a printing medium;

a sensor means provided on the carriage for detecting the mark printed based on a instruction of the mark printing instruction means and the margin of the printing medium; and a correction amount generating means for generating a correction amount corresponding to a distance between the print head and the sensor means on the basis of the carriage displacement positions detected by the carriage position detecting means when the mark is printed by the instruction of the mark printing instruction means and when the mark is detected by the sensor means.

2. The printing apparatus according to claim 1, wherein the carriage position detecting means further comprises a position signal generating means for generating a position signal according to a displacement of the carriage.

3. The printing apparatus according to claim 2, wherein the carriage driving means includes a pulse motor drive based on a pulse, and the carriage position detecting means further comprises a counting means for counting pulses generated corresponding to a driving of the pulse motor by the carriage position signal generating means while the carriage is renewing the displacement position from the original position.

4. A method for a printer to accurately determine a left margin for a sheet of paper, the method comprising the steps of:

turning on the printer;

moving a printer carriage to a home position;

feeding the sheet of paper to a print position;

moving the printer carriage along a print line for a predetermined count of pulses;

stopping the printer carriage;

printing a mark transverse to the print line;

returning the printer carriage to the home position;

advancing the printer carriage along the print line until a sensor detects the mark;

determining a count pulse from the home position to the point where the sensor detects the mark; and calculating a correction amount equal to the difference between the predetermined pulse count and the determined pulse count.

5. The method as claimed in claim 4, further comprising the steps of reverse feeding the sheet of paper until the mark lies on the print line following the return of the printer carriage to the home position and stopping the printer carriage when the sensor detects the mark.

6. The method as claimed in claim 5, further comprising the steps of:

again returning the printer carriage to the home position;

moving the printer carriage along the print line until the sensor detects a lead edge of the sheet of paper; and advancing the printer carriage by a number of pulses equal to the correction amount to position a print head of the printer carriage at the left edge of the sheet of paper.

7. A margin setting apparatus for a printer comprising:

a printer;

a paper support extending between two side frames of the printer;

a printer carriage mounted between the two side frames for reciprocal movement along the paper support;

a print element mounted on the printer carriage;

a sensor mounted on the printer carriage apart from the print element;

a home position detection device for detecting when the printer carriage is at a home position;

a pulse motor for driving the printer carriage; and a control means controlling movement of the carriage, instructing the print element to print a mark on a sheet of paper, and calculating a distance between the print element and the sensor, wherein the sensor is able to detect the mark and lead edge of the paper.

8. The margin setting apparatus as claimed in claim 7, further comprising a position signal generator that generates a signal for each incremental displacement of the printer carriage.

* * * * *